US008152236B1

(12) United States Patent
Romero

(10) Patent No.: US 8,152,236 B1
(45) Date of Patent: Apr. 10, 2012

(54) ADJUSTABLE CHILD RESTRAINING APPARATUS

(76) Inventor: Amanda Romero, New Iberia, LA (US)

( * ) Notice: Subject to any disclaimer, the term of this patent is extended or adjusted under 35 U.S.C. 154(b) by 72 days.

(21) Appl. No.: 12/708,336

(22) Filed: Feb. 18, 2010

(51) Int. Cl.

| | |
|---|---|
| ***A47C 4/00*** | (2006.01) |
| ***A47C 4/28*** | (2006.01) |
| ***A47C 7/42*** | (2006.01) |
| ***A47D 1/02*** | (2006.01) |
| ***A47D 1/10*** | (2006.01) |
| ***A47D 15/00*** | (2006.01) |
| ***A62B 35/00*** | (2006.01) |

(52) U.S. Cl. ..... 297/230.11; 297/16.1; 297/16.2; 297/17; 297/45; 297/230.1; 297/378.1; 297/378.12; 297/378.14; 297/467; 297/485; 297/440.24; 297/230.14; 297/255; 297/256.16; 297/352; 297/230.13

(58) Field of Classification Search ..... 297/16.1, 297/16.2, 17, 45, 230.1, 230.11, 230.12, 297/230.13, 230.14, 252, 255, 256.16, 352, 297/378.1, 378.12, 378.14, 467, 485, 440.24
See application file for complete search history.

(56) References Cited

U.S. PATENT DOCUMENTS

| | | | | | |
|---|---|---|---|---|---|
| 1,192,798 | A | * | 7/1916 | Scott | 297/255 |
| 1,293,592 | A | * | 2/1919 | Wilber et al. | 297/252 |
| 1,546,768 | A | * | 7/1925 | West | 297/255 X |
| 1,814,497 | A | * | 7/1931 | Thompson | 297/252 |
| 2,571,282 | A | * | 10/1951 | Newton et al. | 297/252 |
| 2,587,194 | A | * | 2/1952 | Mitchell | 297/255 |
| 2,613,724 | A | * | 10/1952 | Arnold | 297/255 |
| 2,663,880 | A | * | 12/1953 | Meeks | 297/230.11 X |
| 2,852,066 | A | * | 9/1958 | Hawkins | 297/255 X |
| 2,957,515 | A | * | 10/1960 | Gibson | 297/252 |
| 3,026,142 | A | * | 3/1962 | Holloway | 297/252 |
| 3,146,026 | A | * | 8/1964 | Berlin | 297/255 |
| 3,454,304 | A | * | 7/1969 | Hudak | 297/485 X |
| 3,690,525 | A | * | 9/1972 | Koons et al. | 297/255 X |
| 4,045,834 | A | * | 9/1977 | Mason | 297/352 X |
| 4,416,462 | A | | 11/1983 | Thompson | |
| 4,807,927 | A | * | 2/1989 | Livick | 297/255 X |
| 4,865,380 | A | * | 9/1989 | Heitzman-Powell et al. | 297/230.11 X |
| 4,889,383 | A | * | 12/1989 | Jones | 297/16.1 |
| 4,890,882 | A | * | 1/1990 | Harrington | 297/45 |
| 5,139,308 | A | * | 8/1992 | Ziman | 297/16.1 X |
| 5,222,641 | A | * | 6/1993 | Medeiros, Jr. | 297/255 X |
| 5,366,271 | A | * | 11/1994 | Johnston et al. | 297/250.1 |
| 5,395,154 | A | | 3/1995 | Wang | |
| D372,804 | S | * | 8/1996 | McNamara et al. | D6/368 |
| 5,810,437 | A | * | 9/1998 | Sharpe | 297/255 X |
| 6,206,471 | B1 | | 3/2001 | McGowan | |
| 6,592,187 | B2 | * | 7/2003 | Calvery | 297/352 |
| 6,863,350 | B1 | * | 3/2005 | McCulley et al. | 297/467 X |
| 6,932,429 | B2 | * | 8/2005 | Kamiki | 297/255 |
| 6,969,120 | B2 | | 11/2005 | Levin | |
| 7,000,985 | B2 | * | 2/2006 | Belgarde | 297/255 |
| 7,188,899 | B1 | * | 3/2007 | McClellan-Derrickson | 297/467 X |
| 2008/0018152 | A1 | | 1/2008 | Vadai | |

FOREIGN PATENT DOCUMENTS

| | | | | |
|---|---|---|---|---|
| GB | 2245161 | A | * | 1/1992 |

* cited by examiner

*Primary Examiner* — Rodney B White

(57) ABSTRACT

A restraining apparatus for a child consists of a frame with a back; the back of the frame has parallel back rods which can be adjusted lengthwise and a bottom foldably attached to the back by lockable hinges. The back and the bottom each have a foundation rod further comprising a stop. The apparatus also has a cover for the frame. The cover has an upper portion containing a plurality of slots, and a plurality of straps which fit removably through the slots to adjust to the height of the child to be restrained.

20 Claims, 6 Drawing Sheets

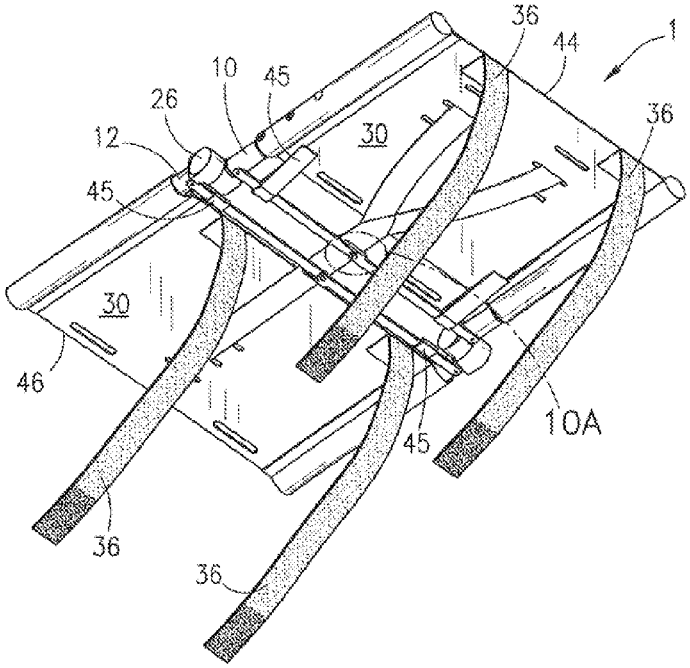
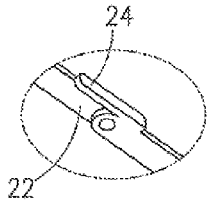
Fig. 10A
Fig. 10
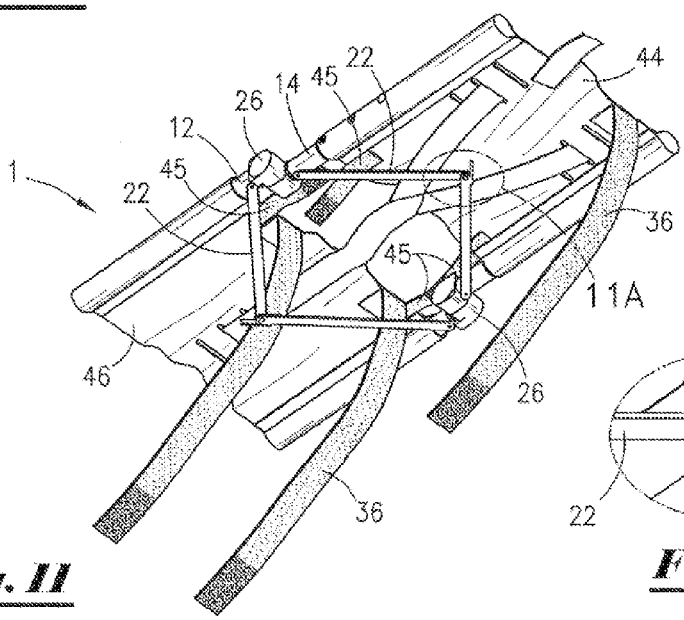
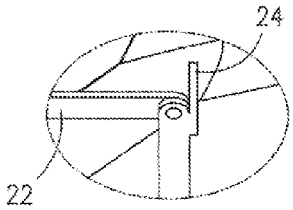
Fig. 11A
Fig. 11

ADJUSTABLE CHILD RESTRAINING APPARATUS

FIELD OF INVENTION

The invention herein disclosed relates to the field of child restraint, and more particularly, relates to an apparatus for restraining a child in a prefabricated seat not crafted to the size of the child to be restrained allowing the child the possibility of excess movement or even escape.

SUMMARY OF INVENTION

A new apparatus for restraining a child in a prefabricated seat is proposed. The new apparatus combines the security of a device, such as a high chair or a shopping cart seat, designed specifically to hold the intended child with the convenience of a portable child seat. Most child seats outside of the home are made to accommodate children of various sizes. Accordingly, many children can move with minimal restriction in these seats which inhibits an adult's freedom while dining, shopping, or engaging in various other activities outside of the home.

It is thought that an apparatus which can be attached to a prefabricated seat and adjusted to accommodate the height and weight of the child to be restrained will eliminate the problem of unrestricted child movement which inhibits adult freedom in a public setting.

BRIEF DESCRIPTION OF THE SEVERAL VIEWS OF THE DRAWINGS

FIG. 10 shows a rear view of the child restraining seat of FIG. 1 with adjustment and restraining straps in place and the foundation rods and stop in an opening position.

FIG. 10A shows an enlarged view of the foundation rods and stop of the child restraining seat shown in FIG. 10

FIG. 11 shows a rear view of the child restraining seat of FIG. 1 with adjustment and restraining straps in place and the foundation rods and stop in a partially closed position.

FIG. 11A shows an enlarged view of the foundation rods and stop of the child restraining seat shown in FIG. 11.

DETAILED DESCRIPTION

Figure 1:
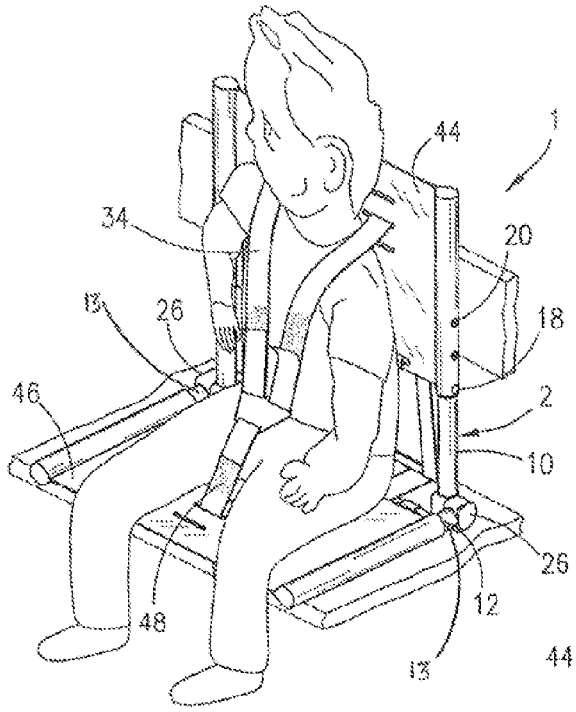
FIG. 1 shows a perspective view of an embodiment of the child restraining seat holding a child.

An embodiment of the proposed apparatus for restraining a child is shown in the accompanying drawings. The apparatus 1 is designed to limit child movement in non-adjustable, pre-fabricated seating, such as high chairs, shopping carts, and bleachers. As shown in FIG. 1, the child restraining apparatus 1 has a frame 2 which has a back 10 and bottom 12. The back 10 and the bottom 12 can also comprise a plurality of inner and outer rods. As shown the back 10 has inner back rods 14 and outer back rods 16. The bottom 12 can be comprised of parallel bottom rods 13, each bottom rod being attached to a corresponding back rod 14 by a hinged 26. The inner back rods 14 and outer back rods 16 can be composed of aluminum, titanium, steel or any other light weight metal. Additionally, the inner back rods 14 and outer back rods 16 can also be composed of plastic.

Figure 7:
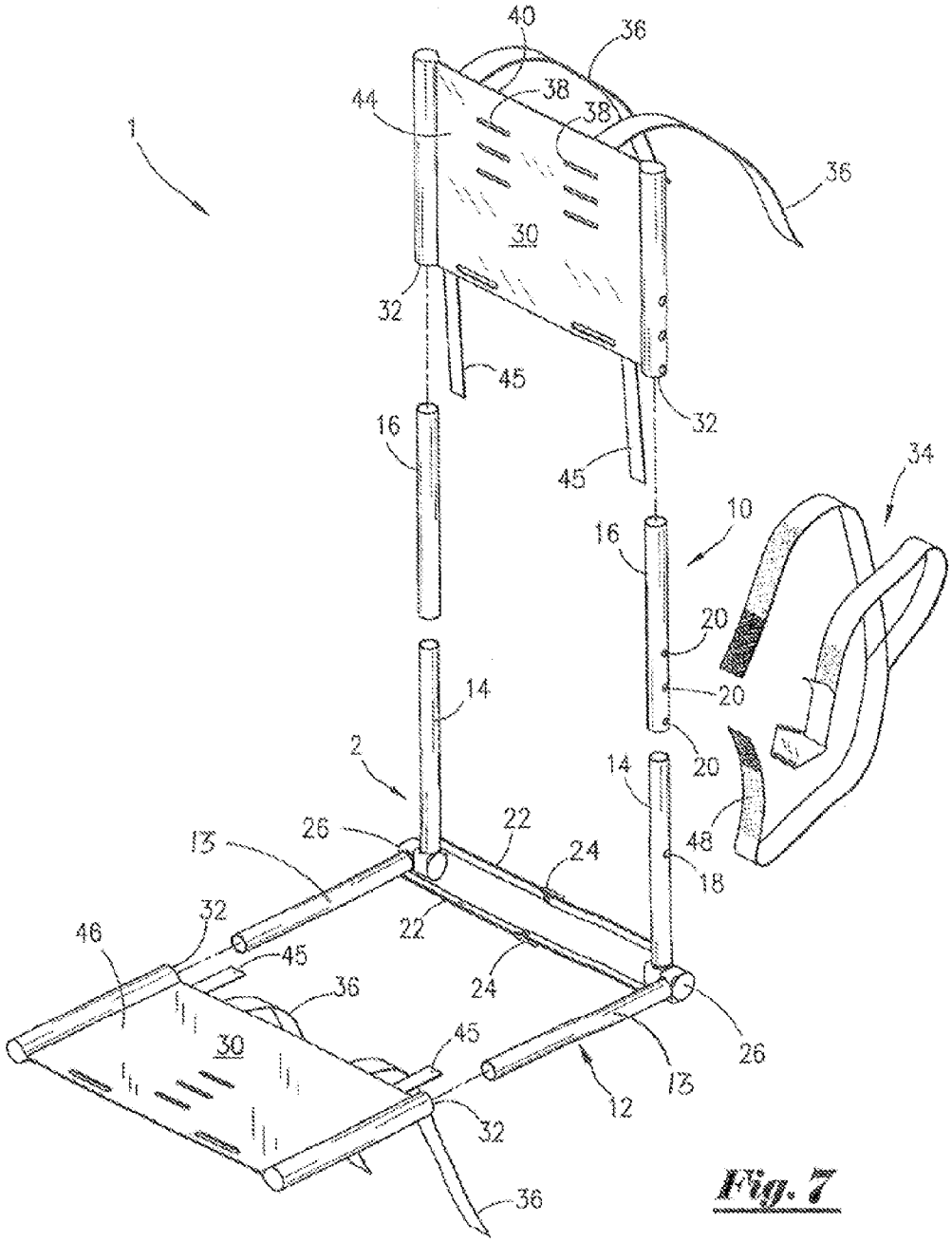
FIG. 7 shows an exploded perspective view of the child restraining seat of FIG. 1.
Figure 8:
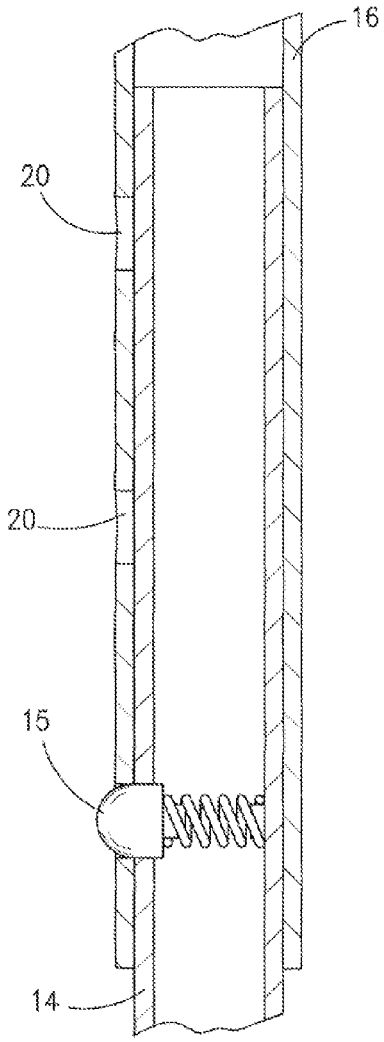
FIG. 8 shows a sectional view of the frame back rod adjustment mechanism of the child restraining seat of FIG. 1 taken along line 10-10.
Figure 9:
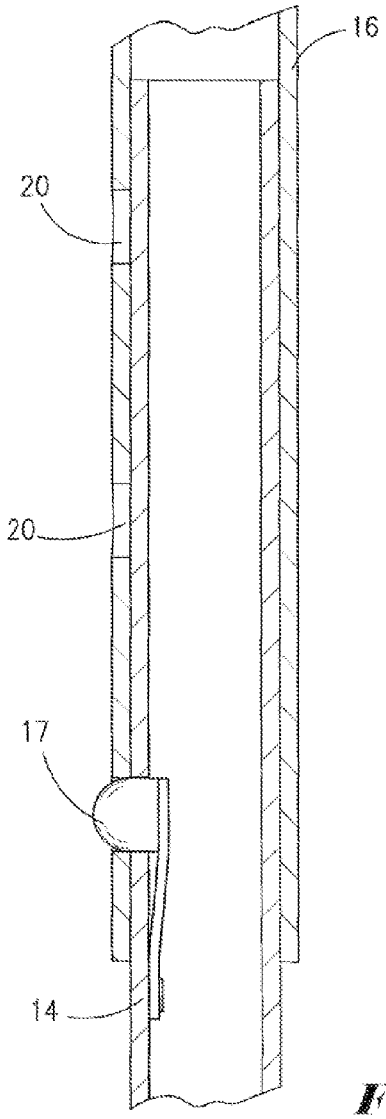
FIG. 9 shows a sectional view of an alternate embodiment of the frame back rod adjustment mechanism of the child restraining seat of FIG. 1 taken along line 10-10.

Referring now to the embodiment depicted in FIG. 7, the back 10 can be adjustable by sliding the outer back rod 16 movably over the inner back rod 14. The bottom 12 can also be adjustable. The ability to adjust the back 10 and/or the bottom 12 of the apparatus 1 allows the apparatus 1 to accommodate children of varying ages and sizes. The outer back rod 16 can be held in place by a protrusion 18 which can be located on the inner back rod 14. The protrusion 18 can fit releasably into one of a plurality of apertures 20 which can be located on the outer back rod 16, as shown in FIGS. 1, 2, 4, and 5. The protrusion 18 can be a compression spring loaded button 15 as shown in FIG. 8. Another embodiment of the protrusion 18 can be a cantilever spring button 17 as shown in FIG. 9.

Figure 2:
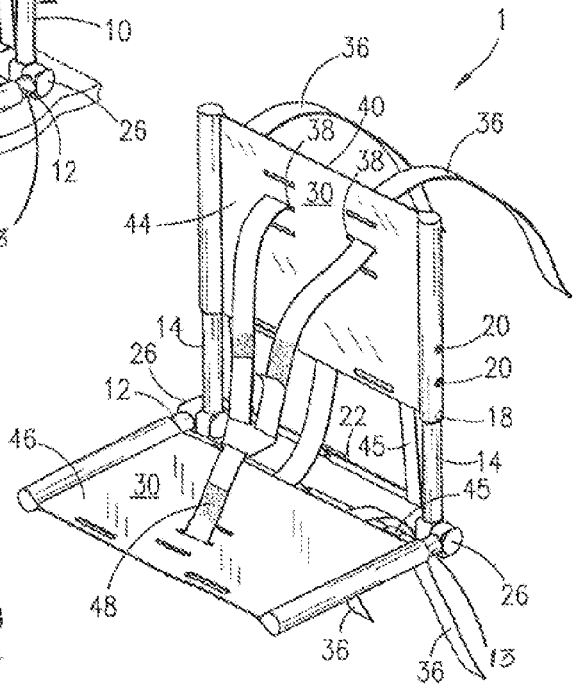
FIG. 2 shows a front perspective view of the child restraining seat of FIG. 1.
Figure 5:
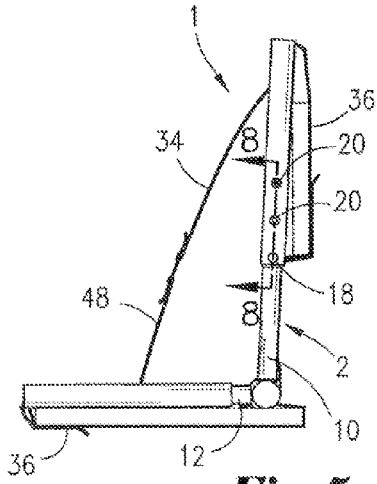
FIG. 5 shows a side view of the child restraining seat of FIG. 1.
Figure 6:
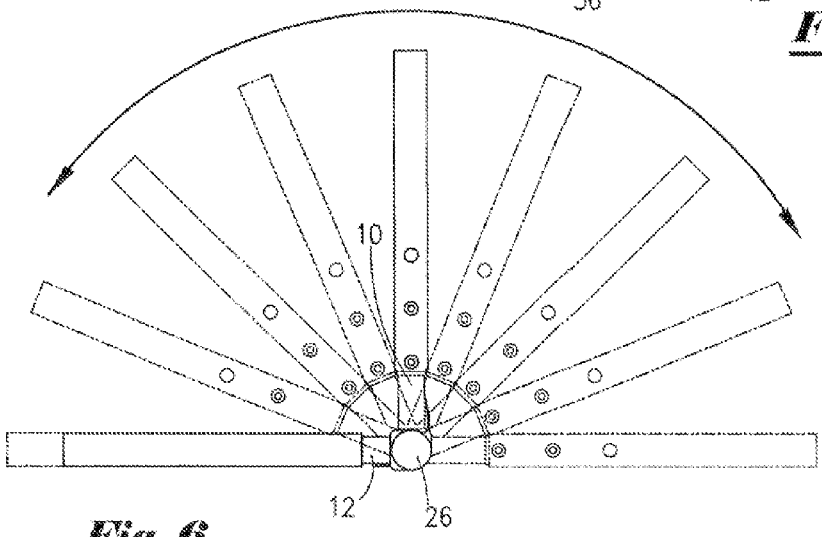
FIG. 6 shows a side view of the adjustable frame of the child restraining seat of FIG. 1.

Referring now to the embodiment shown in FIGS. 2, 5, and 6, the parallel inner back rods 14 and outer back rods 16 of the back 10 can be connected to the parallel inner back rods 14 and outer back rods 16 of the bottom 12 by hinges 26. The hinges 26 can be lockable. As depicted in FIG. 6, the lockable hinges 26 allow the user to control the angle between the back 10 and the bottom 12.

Figure 4:
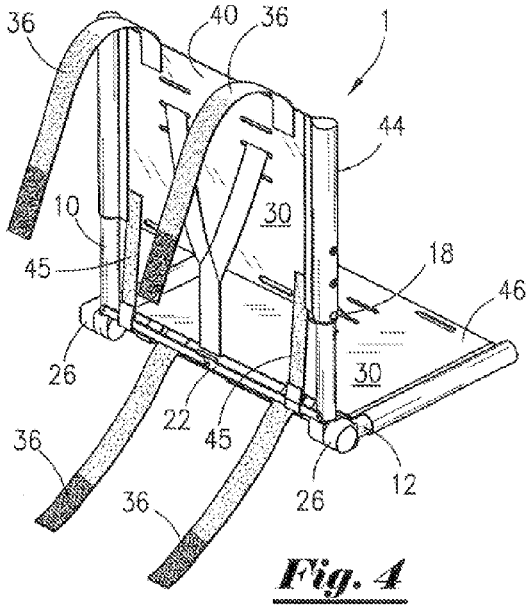
FIG. 4 shows a rear perspective view of the child restraining seat of FIG. 1.

As shown in FIGS. 1, 2, and 7, the child restraining apparatus 1 can also have a cover 30. The cover 30 can be composed of a washable, durable, material such as cotton or polyester. Additionally, the cover 30 can be padded. As shown in FIGS. 2 and 4, the cover 30 can contain an upper portion 44 and a lower portion 46. The upper portion 44 and the lower portion 46 can be joined by connecting straps 45. The upper portion 44 and the lower portion 46 can also be one continuous piece of material. The cover 30 can contain parallel sets of pockets 32 on both its upper portion 44 and its lower portion 46 as depicted in FIGS. 2, 4 and 7. The pockets can fit removably over the parallel inner back rods 14 and outer back rods 16 of the back 10 and bottom 12 of the frame 2 as depicted in FIG. 7. The cover 30 can also be attached to the frame 2 by using Velcro or button closures or can have no attachment means.

Figure 3:
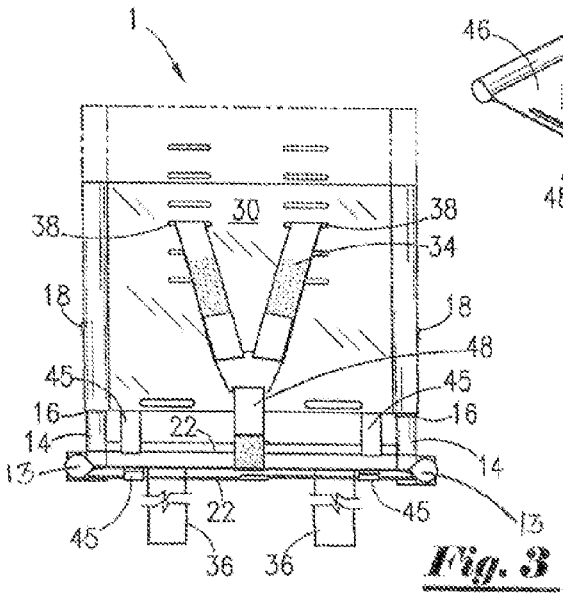
FIG. 3 shows a front view of the child restraining seat of FIG. 1.

Referring now to the embodiment depicted in FIGS. 2, 3, and 4, the cover 30 can contain a plurality of restraining straps 34 and a plurality of attachment straps 36. The attachment straps 36 allow the user to securely connect the apparatus 1 to the desired pre-fabricated seat. The attachment straps 36 can be secured using Velcro, button, snaps, or any other suitable fasteners.

Additionally, the cover 30 can also have a plurality of slots 38, as shown in FIGS. 3 and 7. The restraining straps 34 can be attached to the posterior 40 of the upper portion 44 of the cover 30, and the slots 38 can be positioned on the upper portion 44 of the cover 30. Alternatively, the restraining straps 34 can be completely detachable from the apparatus 1 as shown in FIG. 7. The restraining straps 24 can be padded.

Referring now to FIG. 2, the restraining straps 34 can be placed through any of the plurality of slots 38 and connected to the anchor 48 on the lower portion 46 of the cover 30. The child can then be placed into the apparatus 1 and held securely by the restraining straps 34 which are connected to the anchor 48 on the bottom 12 of the apparatus 1, as shown in FIG. 1. The child is then secured in place without fear of the child disentangling himself due to a one size fits all child seat because the restraining straps 34 have been placed through the slots 38 which correspond to the height of the child to be restrained.

Figure 12:
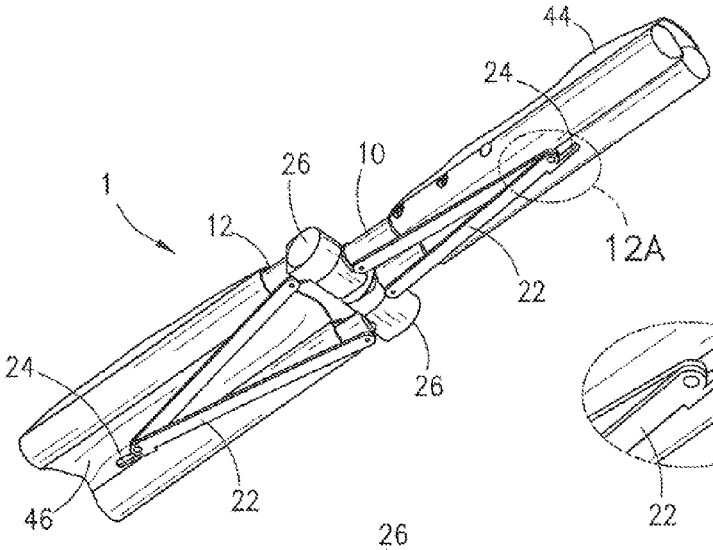
FIG. 12 shows the child restraining seat of FIG. 1 in a closed position.
Figure 12A:
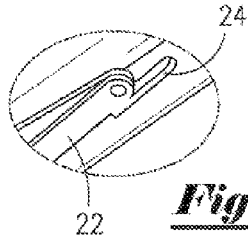
FIG. 12A shows an enlarged view of the foundation rods and stop of the child restraining seat as shown in FIG. 12.

As shown in FIGS. 11 and 12, the restraining apparatus 1 can also be collapsible. After the apparatus 1 has been used to restrain the desired child, the child is then removed, and the apparatus 1 is ready to be collapsed for storage or travel. As shown in FIGS. 4, 7, and 10, the back 10 and the bottom 12 of the frame 2 can have foundation rods 22. The foundation rods can be perpendicular to the inner back rods 14 and outer back rods 16. As shown in FIGS. 10A and 11A, the foundation rods 22 can also contain a stop 24. The foundation rods 22 can be folded by disengaging the stop 24 as depicted in FIG. 11. The foundation rods 22 can collapse inwardly, as in FIG. 11, or outwardly. The stop 24 can be a button or a switch which can be turned.

Figure 13:
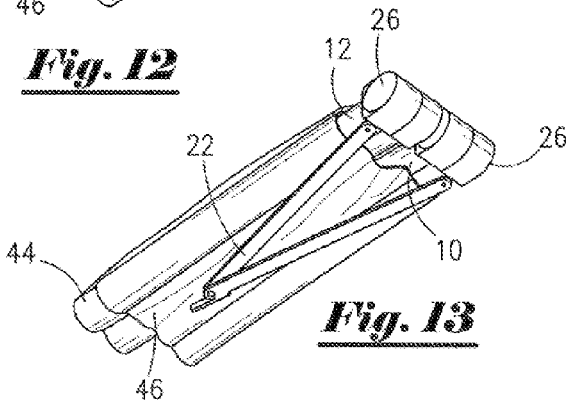
FIG. 13 shows the child restraining seat of FIG. 1 in a closed position with the back section of the frame folded over the seat.
Figure 14:
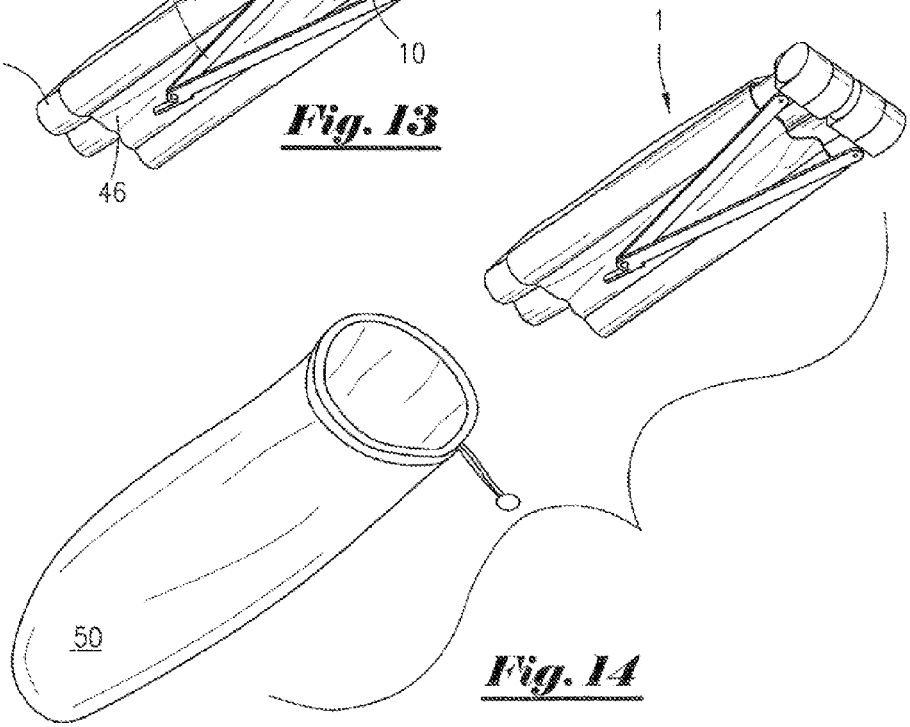
FIG. 14 shows an exploded view of the child restraining seat as shown in FIG. 13 for positioning in a seat carrier bag.

Referring now to FIG. 12, the apparatus 1 can be fully collapsed by pressing the hinges 26 together. The fully collapsed apparatus 1 can then be folded by moving the back 10 to meet the bottom 12 as shown in FIG. 13. The fully collapsed, folded apparatus can then be placed into the carrier 50 for transportation.

The embodiments shown in the accompanying drawings and described herein are exemplary of numerous embodiments that may be made within the scope of the following claims. It is contemplated that many other configurations may be used, and the material of each component may be selected from numerous materials other than those specifically disclosed. In short, it is the applicant's intention that the scope of the patent issuing herefrom will be limited only by the scope of the appended claims.

I claim:

1. A restraining apparatus comprising:

a. a frame; said frame having a back comprising first and second parallel back rods which can be adjusted lengthwise, a bottom comprising first and second parallel bottom rods, each said bottom rod being foldably attached to a corresponding said back rod by a lockable hinge, said back and said bottom each having a foundation rod, each said foundation rod having a disengageable stop whereby said foundation rods may be folded by disengaging said stop and thereby collapsing said back and bottom inwardly; and b. a collapsible cover for said frame, said cover having an upper portion containing a plurality of slots, and a plurality of straps which fit removably through said slots.

2. The apparatus of claim 1 wherein each said back rod further comprises an outer back rod and an inner back rod.

3. The apparatus of claim 2 wherein said inner back rod of each said back rod fits movably inside of said outer back rod of each said back rod.

4. The apparatus of claim 3 wherein said outer back rod of each said back rod contains a plurality of apertures.

5. The apparatus of claim 3 wherein said inner back rod of each said back rod contains at least one protrusion.

6. The apparatus of claim 3 wherein said protrusion of said inner back rod of each said back rod fits releasably into any of said plurality of apertures of said outer back rod of each said back rod.

7. The apparatus of claim 1 wherein said cover further comprises a lower portion and an upper portion.

8. The apparatus of claim 7 wherein said upper portion of said cover and said lower portion of said cover each further comprise at least two parallel openings.

9. The apparatus of claim 8 wherein said parallel back rods fit into said parallel openings of said cover.

10. The apparatus of claim 7 wherein said lower portion of said cover further comprises at least one anchor.

11. The apparatus of claim 10 wherein said restraining straps can fit through said slots on said upper portion of said cover.

12. The apparatus of claim 10 wherein said attachment straps can be located on said bottom of said apparatus.

13. The apparatus of claim 10 wherein said attachment straps can be located on said back of said apparatus.

14. The apparatus of claim 1 wherein said plurality of straps further comprises attachment straps and restraining straps.

15. A method for restraining a child comprising:

a. selecting a prefabricated seat into which a child will be positioned;

b. providing an apparatus for restraining a child into desired position said apparatus comprising a frame; said frame having a back comprising first and second parallel back rods, a bottom comprising first and second parallel bottom rods, each said bottom rod being foldably attached to a corresponding said back rod by a lockable hinge, said back and said bottom each having a pivotally attached foundation rod, each said foundation rod having a disengageable stop whereby said foundation rods may be folded by disengaging said stop and thereby collapsing said back and bottom inwardly; and a fabric cover for said frame, said cover having upper and lower cover portions, said cover containing a plurality of slots; a plurality of attachment straps: a plurality of restraining straps, said attachment straps and said restraining straps configured to fit removably through said slots; and an anchor;

c. unfolding each said foundation rod and engaging said foundation rod stops on said apparatus;

d. adjusting said parallel back rods of the apparatus to accommodate the size of said child;

e. attaching said apparatus to said seat using said attachment straps;

f. selecting slots from a plurality of slots on the back of said apparatus through which to place said restraining straps to accommodate the size of said child;

g. placing said restraining straps through said selected slots to accommodate the size of said child; and h. placing said child on said apparatus and restraining said child by placing said restraining straps round said child and securing said restraining straps to said anchor.

16. The method of claim 15 wherein said hinges are locked.

17. The method of claim 16 further comprising the additional steps of:

a. disengaging said restraining straps from said anchor after a desired time;

b. removing said child from said apparatus;

c. detaching said attachment straps from the seat;
d. removing said apparatus from said seat;
e. disengaging said foundation rod stops;
n. folding said foundation rods and thereby collapsing said apparatus; and
o. placing said apparatus into a holder.

18. The method of claim 15 wherein said bottom rods are adjustable.

19. A restraining seat apparatus comprising:
a. a frame; said frame comprised of a first pair of parallel first rods and second pair of parallel rods, at least one pair of said rods being adjustable in length;
b. lockable hinges whereby said first pair of parallel rods are attached to said second pair of parallel rods;
c. an inwardly collapsible and outwardly extendable cover for said frame, said cover containing a plurality of slots;
d. a plurality of straps which fit removably through said slots;
e. at least one foundation rod, said foundation rod being pivotally mounted between said pairs of parallel rods, said foundation rod being foldable by means of a disengageable stop whereby engagement of said stop will outwardly extend said foundation rod and thereby outward extend said frame and whereby disengagement of said stop will inwardly collapse said foundation rod and thereby inwardly collapse said frame.

20. The restraining seat apparatus as recited in claim 19, wherein said cover is a fabric cover, said fabric cover comprising:
a. means for attaching said cover to said frame; and
b. an anchor for attachment of at least one strap from said plurality of straps.

* * * * *